US007824212B2

(12) United States Patent
Knepper et al.

(10) Patent No.: US 7,824,212 B2
(45) Date of Patent: Nov. 2, 2010

(54) APPARATUS FOR ATTACHING AN ELECTRICAL DEVICE TO A HOUSING

(75) Inventors: Markus Knepper, Waltenhofen/Oberdorf (DE); Karl-Heinz Nuebel, Simmozheim (DE)

(73) Assignee: Robert Bosch GmbH, Stuttgart (DE)

( * ) Notice: Subject to any disclaimer, the term of this patent is extended or adjusted under 35 U.S.C. 154(b) by 35 days.

(21) Appl. No.: 12/288,701

(22) Filed: Oct. 21, 2008

(65) Prior Publication Data

US 2009/0220297 A1 Sep. 3, 2009

(30) Foreign Application Priority Data

Oct. 29, 2007 (DE) ..... 10 2007 051 587

(51) Int. Cl.
*H01R 13/73* (2006.01)

(52) U.S. Cl. ..... 439/544

(58) Field of Classification Search ..... 439/357–358, 439/544

See application file for complete search history.

(56) References Cited

U.S. PATENT DOCUMENTS

| | | | | |
|---|---|---|---|---|
| 2,944,241 | A * | 7/1960 | Londell, Jr. | 439/357 |
| 3,569,903 | A * | 3/1971 | Brishka | 439/352 |
| 3,716,817 | A * | 2/1973 | Wolfe et al. | 439/346 |
| 4,152,041 | A * | 5/1979 | Hollyday et al. | 439/188 |
| 4,390,222 | A * | 6/1983 | Carter | 439/258 |
| 4,540,236 | A * | 9/1985 | Peers-Trevarton | 439/159 |
| 5,115,126 | A | 5/1992 | Ams | |
| 6,669,495 | B2 * | 12/2003 | Philips et al. | 439/170 |
| 7,322,846 | B2 * | 1/2008 | Camelio | 439/352 |
| 7,632,130 | B2 * | 12/2009 | Sami | 439/352 |
| 7,652,888 | B2 * | 1/2010 | Bohlinger et al. | 361/732 |
| 2008/0023625 | A1 | 1/2008 | Plank | |

* cited by examiner

*Primary Examiner*—Edwin A. Leon
*Assistant Examiner*—Larisa Tsukerman
(74) *Attorney, Agent, or Firm*—Kenyon & Kenyon LLP

(57) ABSTRACT

The apparatus simplifies release of the locking connections. The second housing section of the electrical device is designed rotationally asymmetrically in such a way that when rotated about the longitudinal axis, the electrical device at one particular side wall of the second housing section causes the at least one locking connection to open.

13 Claims, 3 Drawing Sheets

APPARATUS FOR ATTACHING AN ELECTRICAL DEVICE TO A HOUSING

BACKGROUND INFORMATION

An apparatus for attaching an ignition coil to a cover in an internal combustion engine is described in U.S. Pat. No. 6,805,086, having an ignition coil which is inserted at a first housing section into an opening in the cover, is provided with a second housing section outside the opening, and is held against the housing via at least one locking connection. A disadvantage is that tools are necessary to release the locking connection.

SUMMARY OF THE INVENTION

The apparatus according to the present invention has the advantage over the related art in that the locking connection may be easily released by hand without additional tools, and in that the second housing section of the electrical device is designed rotationally asymmetrically in such a way that when the second housing section is rotated about its longitudinal axis, each side wall causes the at least one locking connection to open. As a result of the rotation, the side wall of the second housing section elastically spreads apart each locking catch for the locking connection, thereby opening the locking connection. This is achieved by only a slight rotation. In addition, the locking connection may be provided either directly at the ignition coil, at the engine, or at a supplementary component.

According to one advantageous embodiment, the at least one locking connection has a locking catch and an undercut which cooperates with the locking catch, the locking catch being provided on the housing and the undercut being provided on the electrical device, or vice versa.

It is particularly advantageous when the second housing section of the electrical device, viewed in the radial direction with respect to the longitudinal axis, has a narrow dimension and a wide dimension, the wide dimension being larger and the narrow dimension being smaller than the smallest catch distance. In this manner the electrical device may be easily installed or positioned between the two locking catches.

In addition, it is advantageous for the locking connection to be designed in such a way that the undercut may be rotated out of the region of the locking catch, or vice versa. As a result of the bending of the locking catches caused by the rotational motion and the simultaneous rotating out from the region of the locking catch, the locking connection may be opened more easily than in the related art, since only a small rotational angle is needed to open the locking connection.

According to one advantageous embodiment, the second housing section has a rectangular or oval cross section. In this manner rotational asymmetry is achieved very easily.

DETAILED DESCRIPTION

Figure 1:
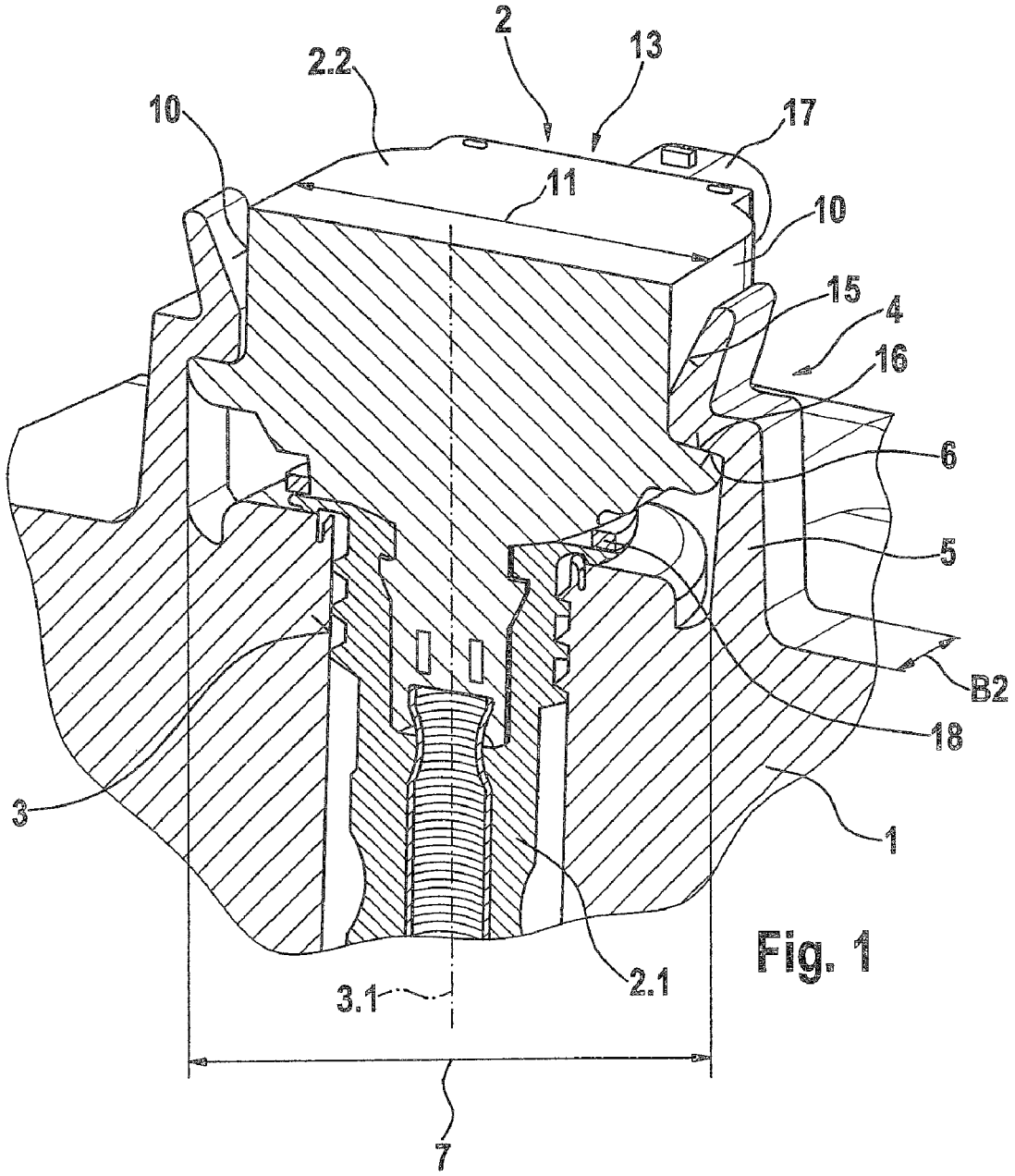
FIG. 1 shows a three-dimensional sectional view of an apparatus according to the present invention for attaching an ignition coil to a housing.

FIG. 1 shows a three-dimensional sectional view of an apparatus according to the present invention for attaching an electrical device to a housing.

The apparatus according to the present invention is used for attaching any given electrical device, for example an ignition coil, to a retaining housing.

The apparatus has a retaining housing 1 and an electrical device 2 which is attached to retaining housing 1. According to the exemplary embodiment, electrical device 2 is an ignition coil and retaining housing 1 is a cover in an internal combustion engine, also referred to as a valve cover or cylinder head cover. Retaining housing 1 has at least one opening 3 into which electrical device 2 projects at a first housing section 2.1. Opening 3 in retaining housing 1 opens into a spark plug bore (not illustrated) in the internal combustion engine. A second housing section 2.2 for electrical device 2 is provided outside opening 3, and is attached to retaining housing 1 via at least one locking connection 4. The at least one locking connection 4 holds electrical device 2 in the axial direction with respect to a longitudinal axis 3.1 of opening 3. Electrical device 2 is held, in the radial direction with respect to longitudinal axis 3.1, by first housing section 2.1 situated in opening 3 with a positive-fit connection.

In the case of an ignition coil, housing section 2.1 is placed during installation on the spark plug without rotating the ignition coil. In contrast, in the related art it is often necessary to rotate the ignition coil to establish the connection, resulting in permanent torsion of housing section 2.1.

In the case of an ignition coil, housing section 2.1 is a high-voltage terminal which conducts the high voltage to the spark plug and has an electrically insulating protective cover. The protective cover provides precise centering of ignition coil 2 in spark plug bore 3.

Locking connection 4 in each case has a locking catch 5 and an undercut 6 which cooperates with locking catch 5, locking catch 5 being provided on retaining housing 1 and undercut 6 being provided on electrical device 2, or vice versa. Locking catch 5 has an elastically flexible design. According to the exemplary embodiment, locking catch 5 is provided on retaining housing 1 and undercut 6 is provided on second housing section 2.2. For example, two locking connections 4 are provided with two locking catches 5 which are situated diametrically opposite one another on retaining housing 1, near opening 3, and in each case cooperate in a locking manner with an undercut 6 provided on second housing section 2.2. Locking catches 5 are separated from one another by a predetermined catch distance 7. Locking catches 5 have a web- or clip-shaped design, for example, nose-shaped catches being provided at the free end of the web or clip.

Electrical device 2 is installed by pressing device 2 in the direction of bore axis 3.1, without rotation, locking catches 5 being spread apart and then springing back to their original position after passing the undercut, thereby preventing device 2 from being pulled out.

In the embodiment according to the present invention, locking connection 4 may be easily released by hand without an additional tool.

According to the present invention, second housing section 2.2 of electrical device 2 has a rotationally asymmetrical design such that when rotated about longitudinal axis 3.1, electrical device 2 at one particular side wall 10 of second housing section 2.2 causes the at least one locking connection 4 to open. Rotational asymmetry is achieved by the fact that second housing section 2.2 of electrical device 2, viewed in the radial direction with respect to longitudinal axis 3.1, has a narrow dimension 11 and a wide dimension 12, wide dimension 12 being larger and narrow dimension 11 being smaller than smallest catch distance 7. For example, second housing section 2.2 has a rectangular or oval cross section to provide second housing section 2.2 with a rotationally asymmetrical design. Two oppositely situated side walls 10 are thus formed, each acting on one of two locking connections 4 when second housing section 2.2 is rotated.

Side walls 10 of second housing section 2.2 elastically spread apart locking catches 5 of locking connection 4 as a result of the rotation, thereby opening locking connections 4 and allowing electrical device 2 to be removed from the retaining device. Only slight rotation and force are necessary for this purpose.

According to the exemplary embodiment, undercut 6 is provided in each case on side wall 10, which cooperates with and opens locking connection 4. These side walls 10 may be flat or curved. Narrow dimension 11 is provided between these side walls 10. Undercut 6 is a shoulder, for example, which is provided in one piece on second housing section 2.2. Shoulder 6 has a clip- or web-shaped design, for example, and width B of shoulder 6, measured in the circumferential direction, decreases in the radially outward direction, for example by rounding or beveling. In this manner the rotational angle necessary for releasing the locking connection is decreased. Width B of shoulder 6 corresponds approximately to width B2 of locking catch 5.

Locking connection 4 is designed in such a way that undercut 6 may be rotated out of the region of locking catch 5, or locking catch 5 may be rotated out of the region of undercut 6. When rotated out, side wall 10 acts on locking catch 5 and elastically spreads it apart. As soon as locking catch 5 has emerged from undercut 6, i.e., no longer overlaps with undercut 6, electrical device 2 may be moved in the axial direction and removed from opening 3.

Locking catches 5 each have an insertion bevel 15 which leads to a catch undercut 16 which locks behind shoulder 6. Insertion bevel 15 and catch undercut 16 form the nose-shaped contour.

Electrical device 2 has an electrical connection 17 which is provided at one of narrow sides 13 having dimension 11. This configuration simplifies introduction of a torque for uninstalling the electrical device.

Viewed in the axial direction, a spring element 18, for example a disk-shaped segment of housing section 2.1 or a spring washer, is provided between retaining housing 1 and electrical device 2 which presses housing 2 upward after it locks against locking catch 5. This provides tolerance compensation and prevents wear during operation as the result of play in the locking connection.

Housing 2 must be protected from twisting during operation as the result of vibrational stress from the engine. In this embodiment of the present invention, this is achieved by a sufficiently large width of locking catches 5 so that when housing 2 twists, locking catches 5 are bent apart, resulting in a restoring torque. The friction of housing section 2.1 in bore 3 likewise assists in preventing twisting.

Figure 2:
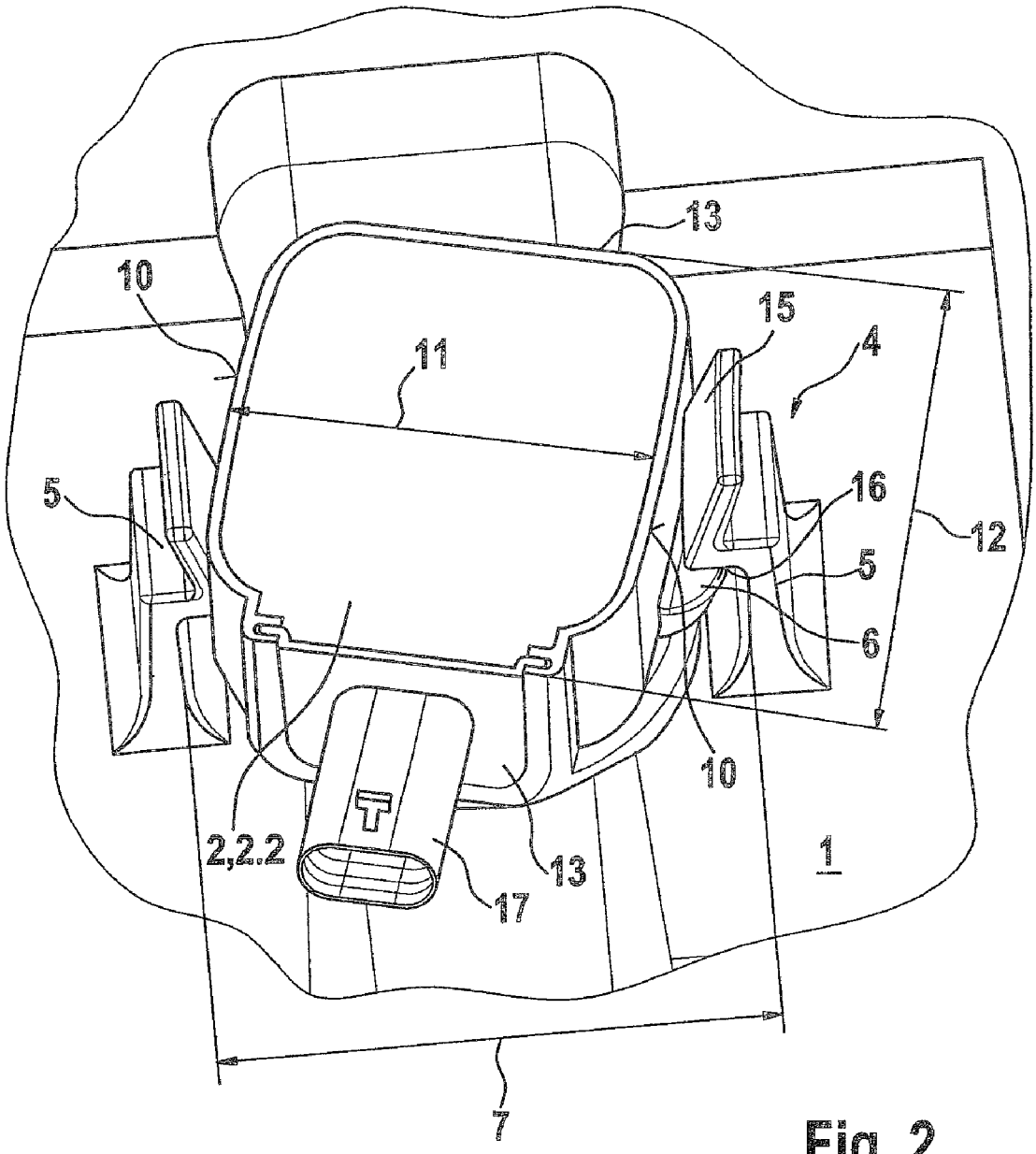
FIG. 2 shows a second view of the apparatus according to the present invention during opening of the locking connection.

FIG. 2 shows a second view of the apparatus according to the present invention.

In the apparatus according to FIG. 2, parts which are identical to or have the same function as the apparatus according to FIG. 1 are denoted by the same reference numerals.

The view shows a position of electrical device 2 in which electrical device 2 has already been rotated by a given angle in order to release locking connection 4. However, locking connection 4 is not yet open.

Figure 3:
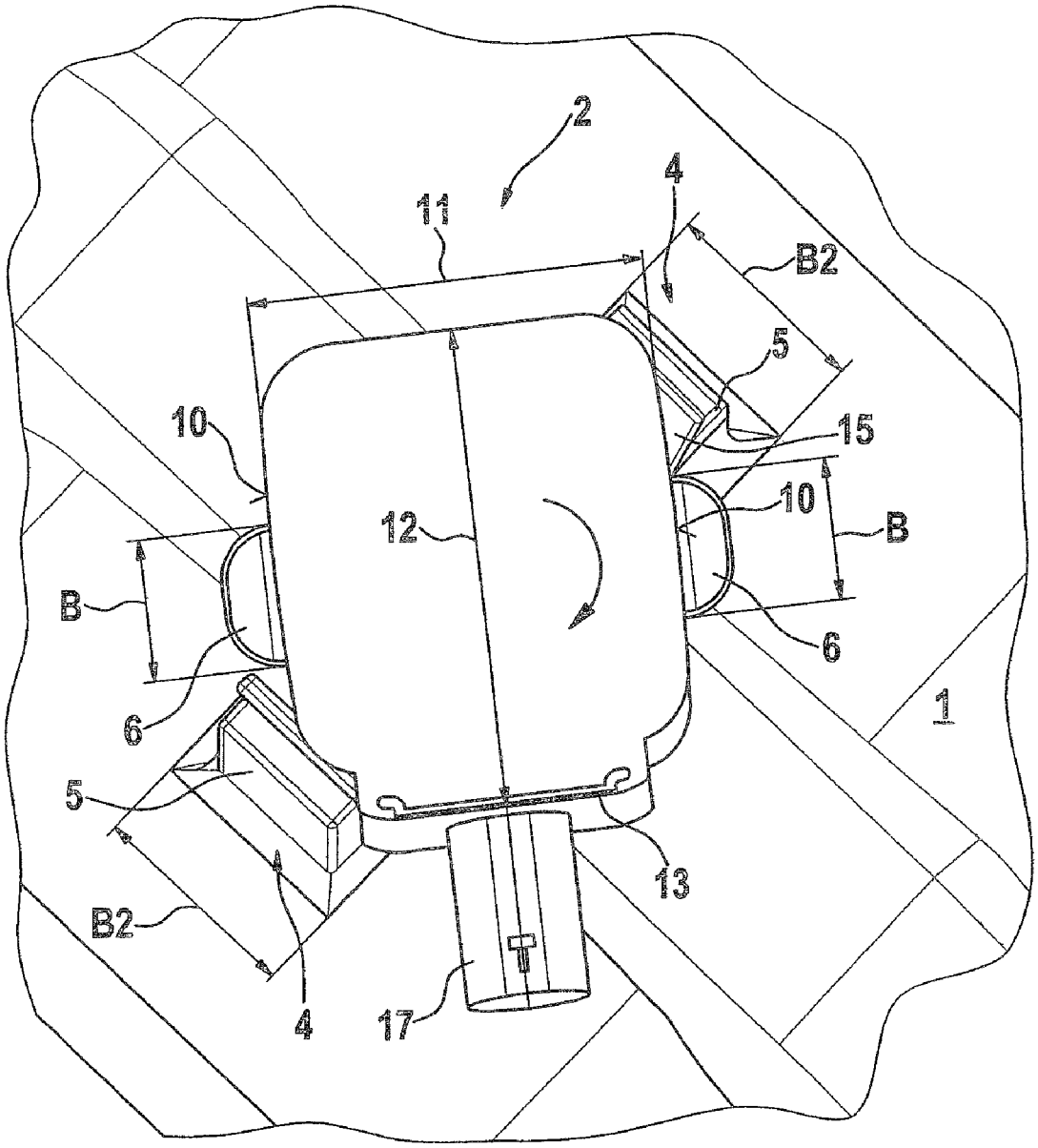
FIG. 3 shows a third view of the apparatus according to the present invention.

FIG. 3 shows a third view of the apparatus according to the present invention.

In the apparatus according to FIG. 3, parts which are identical to or have the same function as the apparatus according to FIGS. 1 and 2 are denoted by the same reference numerals.

The view shows a position of electrical device 2 in which two locking connections 4 have been opened by rotating electrical device 2, and electrical device 2 may be removed from opening 3.

What is claimed is:

1. An apparatus for attaching an electrical device to a housing, comprising:

at least one locking connection; and an electrical device which is inserted at a first housing section into an opening in the housing, is provided with a second housing section outside the opening, and is held against the housing via the at least one locking connection, the second housing section of the electrical device having a rotationally asymmetrical design such that when rotated about a longitudinal axis, the electrical device at one side wall of the second housing section causes the at least one locking connection to open.

2. The apparatus according to claim 1, wherein the at least one locking connection has a locking catch and an undercut which cooperates with the locking catch, the locking catch being situated on the housing and the undercut being situated on the electrical device, or vice versa.

3. The apparatus according to claim 2, wherein the locking connection is designed in such a way that the undercut may be rotated out of a region of the locking catch, or vice versa.

4. The apparatus according to claim 1, wherein the at least one locking connection includes two locking connections each provided with a locking catch, the locking catches being separated from one another by a predetermined catch distance.

5. The apparatus according to claim 4, wherein the second housing section of the electrical device, viewed in a radial direction with respect to the longitudinal axis, has a narrow dimension and a wide dimension, the wide dimension being larger and the narrow dimension being smaller than a smallest catch distance.

6. The apparatus according to claim 2, wherein the undercut of the locking connection is situated on the side wall of the electrical device, which cooperates with and opens the locking connection.

7. The apparatus according to claim 6, wherein the undercut is a shoulder.

8. The apparatus according to claim 7, wherein a width of the shoulder decreases in a radially outward direction.

9. The apparatus according to claim 1, wherein the second housing section has one of a rectangular cross section and an oval cross section.

10. The apparatus according to claim 4, wherein the locking catches have insertion bevels.

11. The apparatus according to claim 2, wherein the locking catch is elastically flexible.

12. The apparatus according to claim 2, wherein the locking catch includes one of a web-shaped and a clip-shaped design.

13. An apparatus for attaching an electrical device to a housing, comprising:

at least one locking connection; and an electrical device which is inserted at a first housing section into an opening in the housing, is provided with a second housing section outside the opening, and is held against the housing via the at least one locking connection, the second housing section of the electrical device having a rotationally asymmetrical design such that when rotated about a longitudinal axis, the electrical device at one side wall of the second housing section causes the at least one locking connection to open, wherein the at least one locking connection has a locking catch and an undercut which cooperates with the locking catch, the locking catch being situated on the housing and the undercut being situated on the electrical device, and wherein the side wall of the second housing section elastically spreads apart each locking catch of the at least one locking connection, thereby opening the at least one locking connection.

* * * * *